United States Patent [19]

Hesh

[11] Patent Number: 4,844,156

[45] Date of Patent: Jul. 4, 1989

[54] METHOD OF SECONDARY EXTRACTION OF OIL FROM A WELL

[76] Inventor: Frank Hesh, 1155 W. Ogden, Naperville, Ill. 60540

[21] Appl. No.: 231,909

[22] Filed: Aug. 15, 1988

[51] Int. Cl.[4] ..... E21B 43/18

[52] U.S. Cl. ..... 166/263; 166/268; 166/372

[58] Field of Search ..... 166/263, 268, 305.1, 166/369, 370, 371, 372

[56] References Cited

U.S. PATENT DOCUMENTS 1,295,243 2/1919 Waitz ..... 166/263
2,115,378 4/1938 Wolf ..... 166/263

OTHER PUBLICATIONS

Petroleum Production Engineering; Oil Field Exploitation; Uren; Chapter IX; McGraw-Hill Book Company, Inc.; 1953.

*Primary Examiner*—William P. Neuder
*Attorney, Agent, or Firm*—Charles F. Lind

[57] ABSTRACT

The invention discloses a method to enhance flow of oil bearing crude from a stripper well, by sealing the concentric well casing and tubing components together across the annular space between these components, at a level generally above any liquid in the casing, to define a sealed space open via perforations in the casing to the surrounding oil bearing formation; by evacuating gases from the defined sealed space to establish subatmospheric pressure conditions therein that may be reduced only by flow of fluids including the crude through the well casing perforations from the surrounding oil bearing formation; by discontining these conditions and immediately thereafter injecting a fluid into the defined sealed space, to pressurize the defined space to superatmospheric pressure conditions; by repeating both phases of the cycle between the subatmospheric and superatmospheric pressure conditions, sequentially over and over; and by operating a lift pump means in the well tubing, at least part of the time during each cycle or between each sequential cycle, to recover oil bearing crude drawn into the well casing.

7 Claims, 1 Drawing Sheet

METHOD OF SECONDARY EXTRACTION OF OIL FROM A WELL

FIELD OF THE INVENTION

This invention relates to a secondary method of extracting or recovering oil from otherwise spent or low producing wells, commonly referred to as stripper wells.

BACKGROUND OF THE INVENTION

A conventional oil well may have a substantially tubular casing extended from the earth's surface to a subterranean oil bearing formation, and a well tubing positioned inside the casing extended between a bottom sump region having accumulations of liquid crude and a recovery wellhead at the surface. In most instances, the casing is perforated in the region of the formation to allow liquid crude seepage into a sump within the casing, and pump means cooperating with the well tubing in the sump, when activated, may move the crude upwardly through the well tubing for recovery at the wellhead.

The subterranean formation may be comprised of a porous or highly fractured rock reservoir, having solid granules of sand or rock separated by crevices and other spaces; and the oil bearing crude is contained in the crevices and other spaces.

In stripper or low producing wells, the crude may be of low concentration, and/or of a high viscosity and low mobility, and/or in pressure equilibrium with the perforated well casing, to the extent that the crude does not flow freely via the crevices and other spaces from the formation to the well casing and into the sump.

To overcome this and recover additional crude from the well, several methods of secondary recovery have been proposed involving the communication with the formation via the perforated well casing.

One approach is to seal the top of the well casing and then inject an incompressible liquid, like water, into the annular interior space between the well casing and tubing, and then build up intense superatmospheric pressures in the well casing and surrounding formation, in an attempt to break up the rock reservoir and/or open the crevices and other spaces to thereby improve the permeability of the formation. Fine solid particulates may be added to the water, to be injected with the water, which become wedged in the formation crevices when under the intense pressures and effective further then to hold the crevices open when the pressures are released.

Another approach, without the well casing being sealed, is to flood water into the well casing, to sink relative to the liquid crude and float the crude to a more concentrated higher pool for recovery. Hot steam instead may be injected into the well casing, to thermally heat the formation and thereby reduce the viscosity of the crude, to free the crude from the formation for flow then to the well sump for recovery. Liquid hydrocarbons, or a solvent or surfactant, may also be injected into the well casing, alone or with a carrier fluid, to chemically release the crude from the formation or dissolve some of the restricting formation. In some instances, combustible fluids may be injected into the well to initiate and support combustion of the crude in the formation, thereby again thermally heating the crude to reduce its viscosity; and further after the fire is water quenched, the steam generates some superatmospheric pressures.

A somewhat different approach proposed has been to evacuate gases from the sealed well casing space, by means of a vacuum pump or blower connected at the wellhead. The subatmospheric pressures in the well casing establish pressure differentials between the well casing and the surrounding formation, effective at times to draw oil bearing gases and liquid crude in the formation toward the casing, to accumulate in the well sump.

Suitable controls, responsive to the liquid crude accumulating in the well sump, may be used to activate the oil lift pump to remove the crude from the well.

SUMMARY OF THE INVENTION

The present invention provides an improved secondary method of extracting or recovering crude from a low or non producing well, by steps including, separately and cyclically, applying subatmospheric and superatmospheric conditions to the surrounding oil bearing formation, via the sealed well casing.

Specifically, the method includes the cyclically repeated steps of evacuating and pressurizing the sealed well casing, for cycling between subatmospheric and superatmospheric pressure conditions in the surrounding well formation. Each phase of the cycle, of drawing the vacuum in or of injecting a fluid into the well casing, may be extended up to a week, or shorter of the order of an hour if suitable subatmospheric and superatmospheric pressure conditions cannot be obtained. Generally, immediately after each phase of the cycle, the next phase is started. The injected fluid may be a gas such as environmental air, nitrogen infused air, or may be a liquid such as water, and may be heated to temperatures of up to 500–600 degrees C. The subatmospheric and superatmospheric pressure conditions may be between 1–40% of an atmosphere and 2–200 atmospheres.

If needed, additional holes may be drilled in the perforated region of the well casing to provide added direct communication between the well casing and the surrounding oil bearing formation. Conversely, if the perforated region of the well casing opens directly to a large pocket of gas, and appropriate subatmospheric and/or superatmospheric pressure conditions cannot be achieved, plugs or seals may be used to block certain of these perforations in an effort to creat a new route for the differential pressures, which may be via casing perforations open only to liquid bearing portions of the formation.

The repeated or cyclically established subatmospheric and superatmospheric pressure differentials between the oil bearing formation and well casing, serve to open up the crevices in the rock reservoir to improve permeability, to break down and dislodge the oil bearing crude from the solid formation carrier, and otherwise to draw such crude to the well sump.

BRIEF DESCRIPTION OF THE DRAWINGS

Further objects, advantages and features of the present invention will appear from the following disclosure and description, including as a part thereof the accompanying drawing, in which.

DETAILED DESCRIPTION OF AN ILLUSTRATED EMBODIMENT

Figure 1:
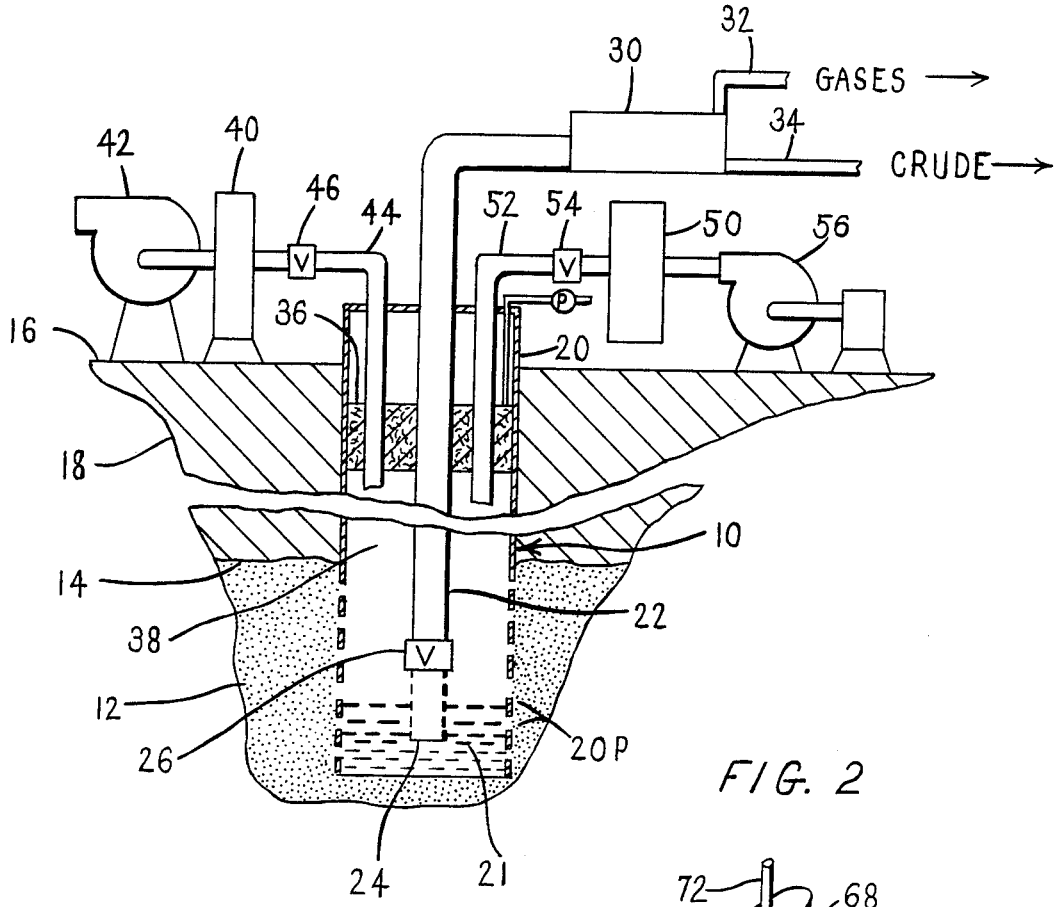
FIG. 1 is a sectional view of a typical oil well, showing a preferred embodiment of the invention incorporated therein.

FIG. 1 illustrates somewhat schematically a typical cross section of the earth through an oil well 10 operatively associated with an oil bearing formation or rock reservoir 12. The oil bearing formation 12 typically will be of a sand or highly fractured rock, having many separate crevices and other spaces between the solid sand or rock, to essentially be porous; and oil bearing liquid, or crude, is contained in the crevices and other spaces. The oil bearing crude in the formation normally would below a certain level 14 typically spaced substantially below the earth's surface 16; and commonly, a cap rock 18 of impermeable clay or shale overlies the oil bearing liquid between the level 14 and the surface 16.

The oil well 10 illustrated is of conventional structures and components, however showing also modifications needed to practice the subject invention. Thus, the well 10 has of a tubular well casing 20, set in a bore hole in the earth and extended from above the surface 16 to within the oil bearing formation 12, and the casing is perforated as at 20P in the region within the crude bearing formation 12. This allows the crude to enter the well casing 20 and accumulate therein near its lower end somewhat as in a sump 21. An imperforate well tubing 22 fits in the casing 20, and likewise extends from above the earth's surface 16 to its lower open inlet end 24 located in the sump region 21, preferably below the liquid level 14. The inlet end 24 of the well tubing 22 may be raised or lowered to the position or debth desired, as the tubing 22 is comprised as a string of separable sections connected together.

Pump means (not shown) is adapted to cooperate with the well tubing in the sump region 21, operable to force the crude up the well tubing 22 for recovery via a wellhead at the earth's surface 16. Valve means 26 provided in the tubing 22 above the inlet 24, is operable to open and close the tubing when needed. Controls (not shown) may respond to the presence of the crude in the sump 21 to operate the pump only when there is sufficient crude at the pump.

The wellhead may include a separator 30 communicating with the upper end of the tubing 22, operable to separate gases recovered with the crude liquid, for discharge via line 32 to conventional processing and/or emission treatment equipment before being discharged to the atmosphere. The recovered liquid crude is discharged via line 34, to storage tanks and/or processing or refining equipment of conventional design.

A plug or seal 36 is adapted to be provided in the well casing 20, between the casing itself and well tubing 22, effective to seal the well casing and tubing components together across the annular space 38 between these components. The seal 36 typically will be located at a level above any perforations in the casing 20 that open to the surrounding oil bearing formation 10; although it may be located elsewhere as will be noted later.

A conventional source of vacuum, including a reservoir 40 and pump 42, is provided proximate the wellhead at the surface, and is connected by a line 44 extended in sealed relationship therewith through the seal 36 to within the annular sealed space 38 between the well casing and tubing components. A valve 46 allows the line 44 to be opened or closed.

Also, conventional sources of fluid, including a reservoir 50, is provided proximate the wellhead at the surface, and is connected by a line 52 extended in sealed relationship therewith through the seal 36 to within the annular sealed space 38 between the well casing and tubing components. A valve 54 allows the line 52 to be opened or closed.

For the different modes of operation to be noted, different conventional sources of fluid might be needed, including a source of a gas such as atmospheric air and/or of another gas such as nitrogen to use pure or as added with the air, and/or a source of water or steam including a boiler, and pump or compressor means 56 to generate the pressures required in the line 52. However, for the sake of simplicity, only a single source of such fluid is illustrated.

Figure 2:
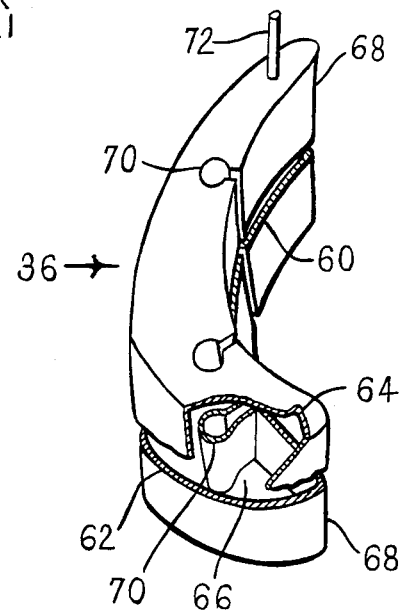
FIG. 2 is an enlarged fragmentary prespective view showing additional details of a separate seal component used in the invention.

FIG. 2 illustrates the seal 36 in greater detail, having inner and outer walls 60 and 62 and upper and lower walls 64 and 66. The inner wall 60 further has several contoured tube walls 70 shaped off of it, somewhat as cutouts from the inner wall, adapted to fit around and receive the lines 44 and 52 in the casing. The seal walls are formed of flexible imperforate material and connected together in a manner to provide that the seal is hollow and air-tight, and a flexible air hose 72 is connected to the upper seal wall 64 and is sufficiently long to extend within the well casing from the seal 36 as positioned and an air pump 74 at the surface.

The seal walls 60, 62 and 70 are extended well in excess of several I.D.s of the casing 20, to provide axial cooperation between the walls and the casing, the tubing 22 and lines 44 and 52 over this distance. Also, the inner and outer walls 60 and 62, and the top and bottom walls 64 and 66, each is slightly longer than the inside circumference of the well casing 20, to allow the seal 38 to be curved on itself and fitted within the casing 20, between the casing and the tubing 22, and extended completely around the casing so that its ends 68 touch and/or overlap slightly. Tape or wire means (not shown) may hold the ends 68 together with the seal 36 in this somewhat torus shape, while the uninflated seal yet fits loosely around the oil lift tubing 22 and vacuum and pressure lines 44 and 52, and loosely within the casing.

SUMMARY OF THE OPERATION

As has been noted above, many factors including the concentration and/or viscosity of the crude and/or its bonding to the rock carrier, and/or the equilibrium pressure conditions between the oil bearing formation and the well sump 21, determine the productive output from the well. The invention to be disclosed now may be practiced with the illustrated well structures and components, in an effort to enhance recovery from stripper wells or otherwise spent or low producing wells.

The invention provides for separate phases of subjecting the formation, via the established communication therewith of the well casing perforated at 20P in the region of the oil bearing formation 12, to subatmospheric and superatmospheric pressure conditions, repeating both phases sequentially over and over, and by operating the lift pump means in the well tubing at least part of the time during each cycle or between each sequential cycle to recover oil bearing crude drawn into the well casing and in the sump 21.

In use, the uninflated seal 36 can be positioned within the well casing 20 annularly of the oil lift tubing 22 and the lines 44 and 52 therein. There is sufficient flexibility and wall material available, with the uninflated seal 36, to allow the axial position of the seal within the well casing to be changed, including to overlying some of the uppermost casing perforations 20P. When the seal 36 in inflated, the flexible walls snuggly engage the adjacent casing 20, tubing 22 and lines 44 and 52, to establish an imperforate barrier between the annular space 38 and the exterior atmosphere, except via the casing, tubing and lines components.

A typical cycle may begin by evacuating gases from the defined sealed annular space 38, by opening the valve 46 to connect the vacuum reservoir 40 with the annular space 38 via the line 44. Evacuation of the gases in the well casing continues with an effort to establish a vacuum of the order of 1–40% of an atmosphere. After the appropriate vacuum has been established and stablized, the invention provides for it to be held for an extended duration between a few hours and a week or so.

The reduced pressure in the well space 38 is communicated via the casing perforations 20P to the surrounding oil bearing formation 10, and may be effective to draw fluids including the oil bearing liquid crude from the surrounding oil bearing formation 10.

After the selected duration of holding the vacuum, the vacuum is discontinued by closing the valve 46, and immediately thereafter, the selected fluid is injected into the defined sealed annular space 38 by opening the valve 54 to pressurize the defined annular space and the surrounding oil bearing formation 10, to a superatmospheric pressure of the order of 2–100 atmospheres. Again, once the selected pressure buildup is stablized, it is held for an extended duration between a few hours and a week or so.

The lift pump means (not shown) cooperating with the well tubing 22 may be operated at least part of the time during each phase of the cycle or between each sequential phase, to recover the liquid crude accumulated in the well casing sump 21.

The injected fluid may be between the environmental temperature and elevated temperatures up to possibly 500–600 degrees C. and may be at pressures between several and several hundred atmospheres. Atmospheric air may be the fluid used, or a noncombustible stable gas such as nitrogen any be added to the air, to be injected therewith into the well casing. The elevated temperatures reduce the viscosity of the crude, for improved mobility to flow to the sump.

Although a gas is preferred as the injected fluid during the cyclic alternation between subatmospheric and superatmospheric pressures, it also is possible to inject water of environmental temperatures, or heated to 200–500 degrees C. and in the form of superheated steam under corresponding high pressures. Under such circumstances however, it would be preferred to locate the lower inlet end 26 of tubing 22 above the level of water from the steam condensing, to avoid pumping the water up with the recovered crude. For similar reasons, the lower end of vacuum tube 44 should be above the level of any liquid in the well, such as water from the steam condensing and/or steam.

It will be appreciated that the time needed to develop the intended subatmospheric or superatmospheric pressures may vary significantly, from only a few minutes to several hours, or possibly never. This may be caused by many factors, including the capacity of the vacuum or pressure generating equipment used compared to the volume of the sealed well casing space 38 and the permeability of the formation 10 and/or the percentage of gas and/or the existance and proximity of gas pockets (not shown) in the surrounding formation 10.

If the perforated region 20P of the well casing opens directly to a large pocket of gas or the like, and appropriate subatmospheric and/or superatmospheric pressure conditions cannot be readily achieved, a second seal similar to seal 36 may be positioned in the well casing, to lie across and close some of the perforations therein, in an attempt to create a new route for the differential pressures, which may be via casing perforations open only to liquid bearing portions of the formation. The vacuum and fluid lines 44 and 52 would extend to below this second seal, to open to the defined annular space 38 also below this seal.

In certain well situations where the well casing perforations open to a gas pocket, rather than operating the vacuum means for an extended duration in an attempt to generate the proposed vacuum, it may be preferred to use superatmospheric pressures instead. This may reduce the viscosity of the crude and/or establish positive pressure conditions between the oil bearing formation and the well sump 21 and/or increase the permeability of the formation, each of which may increase the oil recovery rate.

If continued efforts fail, the duration of attempting to develop either the vacuum or the pressure should be shortened and the corresponding frequency of repetitions of the overall cycle should be increased. Thus, the duration for holding the vacuum may be of the order of an hour when the maximum vacuum that can be established and held has a pressure 40% or greater of an atmosphere; and the duration for holding the pressure may be of the order of an hour when the maximum pressure that can be established and held is not even 2 atmospheres of pressure. Conversely, the duration for holding the vacuum may be of the order of a week when the maximum vacuum that can be established and held has a pressure as low as 10% of an atmosphere; and the duration for holding the pressure may be of the order of a week, when the maximum pressure that can be established and held in the defined sealed space is of the order of 20 atmospheres.

Also, if continued efforts fail, attempts should be made to heat the injected fluid or to inject a solvent or surfactant with the fluid.

If needed, additional holes may be drilled in the perforated region of the well casing to provide added direct communication between the well casing and the surrounding oil bearing formation.

The repeated or cyclically established subatmospheric and superatmospheric pressure differentials between the oil bearing formation and well casing serve to open up the crevices in the rock reservoir to improve permeability, to break down and dislodge the oil bearing crude from the solid formation carrier, and otherwise to draw such crude to the well sump.

While only a single embodiment of the invention has been illustrated, it is apparent that variations may be made therefrom without departing from the inventive concept. Accordingly, the invention is to be limited only by the scope of the following claims.

What is claimed as my invention is:

1. A method to enhance flow of oil bearing crude from a stripper well, comprising the steps of sealing the concentric perforated well casing and the tubing components therein together across the annular space between these components, to define a sealed space within the casing communicating via the perforations therein with a surrounding oil bearing formation;

evacuating gases from the defined sealed space to establish a subatmospheric pressure therein that may be increased only by flow of fluids including the crude through the well casing perforations from the surrounding oil bearing formation;

the duration for evacuation gases being short, of the order of an hour, when the subatmospheric pressure that can be established and held is not less than 40% of an atmosphere;

the duration for evacuation gases being extended, of the order of a week, when the subatmospheric pressure that can be established and held is as low as 10% of an atmosphere;

discontinuing the step of evacuating gases from the defined sealed space and immediately thereafter injecting a fluid into the defined sealed space, to pressurize the sealed space to a superatmospheric pressure;

the duration for injecting the fluid being short, of the order of an hour, when the superatmospheric pressure that can be established and held is not more than 2 atmospheres;

the duration for injecting the fluid being extended, of the order of a week, when the superatmospheric pressure that can be established and held is of the order of 20 atmospheres;

discontinuing the step of injecting a fluid into the defined sealed space, and repeating both of the above mentioned steps with the resulting subatmospheric and superatmospheric pressures, sequentially over and over; and operating lift pump means cooperating with the well tubing, at least part of the time during each step of the cycle or between sequential steps, to recover oil bearing crude drawn into the well casing via the perforations.

2. A method to enhance flow of oil bearing crude from a stripper well, according to claim 1, wherein the subatmospheric pressure held in the defined sealed space is of the order of 1–40% of an atmosphere.

3. A method to enhance flow of oil bearing crude from a stripper well, according to claim 1, wherein the superatmospheric pressure held in the defined sealed space is of the order of 2–100 atmospheres.

4. A method to enhance flow of oil bearing crude from a stripper well, according to claim 1, wherein the subatmospheric pressure held in the defined sealed space is of the order of 1–40% of an atmospherec, and wherein the superatmospheric pressure held in the defined sealed space is of the order of 2–100 atmospheres.

5. A method to enhance flow of oil bearings crude from a stripper well, according to claim 1, wherein the subatmospheric pressure held in the defined sealed space is of the order of 1–40% of an atmospherec, wherein the fluid is heated to temperatures up to 600 degrees C. before being injected into the sealed space, and wherein the superatmospheric pressue held in the defined sealed space is of the order of 2–100 atmospheres.

6. A method to enhance flow of oil bearing crude from a stripper well, according to claim 5, further including surfactant means carried with the injected fluid, to be simultaneously injected into the sealed space with the fluid.

7. A method to enhance flow of oil bearing crude from a stripper well, according to claim 5, further including said fluid being superheated steam heated to temperatures between 200–500 degrees C. under corresponding pressures before being injected into the sealed space.

* * * * *